US007050738B2

(12) United States Patent
Amanai

(10) Patent No.: US 7,050,738 B2
(45) Date of Patent: May 23, 2006

(54) IMAGE-FORMING APPARATUS

(75) Inventor: Kohji Amanai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 150 days.

(21) Appl. No.: 10/856,845

(22) Filed: Jun. 1, 2004

(65) Prior Publication Data

US 2005/0019063 A1 Jan. 27, 2005

(30) Foreign Application Priority Data

Jun. 23, 2003 (JP) ..... 2003-177559
Jul. 30, 2003 (JP) ..... 2003-204037

(51) Int. Cl.
*G03G 15/02* (2006.01)

(52) U.S. Cl. ..... 399/111; 399/116; 399/159; 399/167

(58) Field of Classification Search ..... 399/110, 399/111, 116, 117, 159, 167; 464/160, 162, 464/169, 179, 182
See application file for complete search history.

(56) References Cited

U.S. PATENT DOCUMENTS 6,128,454 A * 10/2000 Kawai et al. ..... 399/116
6,175,706 B1 * 1/2001 Watanabe et al. ..... 399/167
6,400,914 B1 * 6/2002 Noda et al. ..... 399/90

FOREIGN PATENT DOCUMENTS

JP 7-160172 6/1995
JP 7-239596 9/1995
JP 7-243511 9/1995
JP 2002-227866 8/2002
JP 2003-122188 4/2003

* cited by examiner

*Primary Examiner*—Hoan Tran
(74) *Attorney, Agent, or Firm*—Oblon, Spivak, McClelland, Maier & Neustadt, P.C.

(57) ABSTRACT

A transmission device includes a rotation shaft, a gear coaxially fixed to the rotation shaft by press-fitting, and a restriction member fixed to the rotation shaft for restricting perpendicularity of the gear to the axial line of the rotation shaft by pressing in contact with one end face of the gear so as to transmit the rotation of the driven gear onto the rotation shaft for rotating a photosensitive drum fixed to the rotation shaft. The rotation shaft can be fitted into a mounting hole of the gear with a small force so as to improve efficiency in assembling these components.

21 Claims, 9 Drawing Sheets

IMAGE-FORMING APPARATUS

BACKGROUND OF THE INVENTION

1. Field of the Invention

The present invention relates to a transmission device including a transmission member and a rotation shaft fitted into a mounting hole, which is formed in the transmission member, by press-fitting, a photosensitive drum fitted to the rotation shaft of the transmission device, a process cartridge including the photosensitive drum, and an image-forming apparatus.

2. Description of the Related Art

Transmission devices having transmission members, each including a gear, a pulley, or a roller, and rotation shafts, each fitted into a mounting hole formed in the transmission member, have been employed in various technical fields. In image-forming apparatuses, for example, a transmission device, in which a transmission member is rotated and the rotation is transmitted to a photosensitive drum via a rotation shaft, is disclosed in Japanese Unexamined Patent Application Publication No. 7-239596 (P7–8, FIG. 6).

In such conventional transmission devices, the outer diameter of the rotation shaft is set to be smaller than the inner diameter of the mounting hole of the transmission member so that the rotation shaft is loosely fitted into the mounting hole during the assembling of the transmission device. Then, the transmission member has been generally fixed to the rotation shaft with a screw so as to enable these members to integrally rotate. By such a structure, when the mounting hole of the transmission member is fitted to the rotation shaft, a large force is not necessary for easily fitting both the members with each other.

However, if the rotation shaft is loosely fitted into the mounting hole of the transmission member, a small clearance is produced between both the members after they are fitted to each other. In this state, if the transmission member is fixed to the rotation shaft with a screw, the transmission member may be assembled eccentrically to the rotation shaft. The rotation transmission by such a transmission device having eccentricity produces an uneven speed of the rotation, so that various problems arise therefrom. For example, when the photosensitive drum is fixed to the rotation shaft while the transmission member including a gear is fixed to the rotation shaft so that the gear is rotated so as to transmit the rotation to the photosensitive drum, as the example described above, if the gear is eccentric to the axial line of the rotating shaft, even when the gear is rotated so as to maintain the angular speed constant, an uneven rotational speed is produced in the gear.

Such an uneven speed is transmitted to the photosensitive drum via the rotation shaft so as to produce inconsistencies in density of toner images formed on the surface of the photosensitive drum. In a color image-forming apparatus, in which toner images on a plurality of photosensitive drums are transferred onto a recording medium directly or via a transcriptive intermediate, because of the uneven rotational speed of the photosensitive drums, color misalignment and changes in a hue are generated in color images transferred on the recording medium, deteriorating the image quality.

Then, the rotation shaft seems to be fitted into the mounting hole formed in the transfer member by press-fitting. In such a manner, when the rotation shaft is completed to fit the mounting hole, a rattly clearance is not produced between both members, substantially eliminating the eccentricity of the transfer member due to the rattly clearance. The above-mentioned defects, therefore, can be prevented from being generated.

However, when the rotation shaft is fitted into the mounting hole of the transmission member by press-fitting, a large force is required for the fitting. In the case where the transmission member is a resin molded product, the inner diameter of the mounting hole may largely change in size up to a range of 20 μm, for example, because of variations during molding and the ambient temperature. Thus, when the inner diameter of the mounting hole is varied in a decreasing direction, a very large press-fitting force is necessary for fitting the rotation shaft into the mounting hole by the press-fitting, greatly deteriorating the assembly efficiency.

Technologies relating to the present invention are also disclosed in, e.g., Japanese Unexamined Patent Application Publication No. 7-160172, No. 7-243511, No. 2002-227866, and No. 2003-122188.

SUMMARY OF THE INVENTION

The present invention has been made in view of the new recognition mentioned above, and it is an object thereof to provide a transmission device in that a rotation shaft can be easily fitted into a mounting hole of a transmission member by press-fitting, a photosensitive drum fitted to the rotation shaft of the transmission device, a process cartridge having the photosensitive drum, and an image-forming apparatus including the transmission device, the photosensitive drum, or the process cartridge.

In accordance with the present invention, there is provided a transmission device which comprises a transmission member and a rotation shaft fitted into a mounting hole formed in the transmission member. The mounting hole and the rotation shaft are arranged so that part of the internal surface defining the mounting hole in the peripheral direction is only brought into contact with the external surface of the rotation shaft.

In accordance with the present invention, there is also provided a photosensitive drum to be connected to a rotation shaft of a transmission device. The transmission device comprises a transmission member, the rotation shaft fitted into a mounting hole formed in the transmission member by press-fitting and a claw member. The photosensitive drum is fitted to the rotation shaft of the transmission device with the claw member therebetween so as to rotate together with the rotation shaft.

In accordance with the present invention, there is also provided a process cartridge. The process cartridge comprises a photosensitive drum to be connected to a rotation shaft of a transmission device that comprises a transmission member and the rotation shaft fitted into a mounting hole formed in the transmission member by press-fitting, and at least one process instrument for forming toner images on the photosensitive drum.

In accordance with the present invention, there is also provided an image-forming apparatus comprising a transmission device. The transmission device comprises a transmission member and a rotation shaft fitted into a mounting hole formed in the transmission member by press-fitting. The mounting hole and the rotation shaft are arranged so that part of the internal surface defining the mounting hole in the peripheral direction is only brought into contact with the external surface of the rotation shaft.

In accordance with the present invention, there is also provided an image-forming apparatus comprising a photosensitive drum to be connected to a rotation shaft of a transmission device. The transmission device comprises a transmission member, the rotation shaft fitted into a mounting hole formed in the transmission member by press-fitting, and a claw member. The photosensitive drum is fitted to the rotating shaft of the transmission device with the claw member therebetween so as to rotate together with the rotation shaft.

In accordance with the present invention, there is also provided an image-forming apparatus comprising a process cartridge. The process cartridge comprises a photosensitive drum to be connected to a rotation shaft of a transmission device that comprises a transmission member and the rotation shaft fitted into a mounting hole formed in the transmission member by press-fitting and at least one process instrument for forming toner images on the photosensitive drum.

In accordance with the present invention, there is also provided an image-forming apparatus comprising a plurality of photosensitive drums, each drum forming toner images with a color different from each other so as to transfer them onto a recording medium directly or via a transcriptive intermediate and to have recording images. Each of the photosensitive drums is connected to a rotation shaft of a transmission device. The transmission device comprises a transmission member, the rotation shaft fitted into a mounting hole formed in the transmission member by press-fitting, and a claw member. Each of the photosensitive drums is fitted to the rotating shaft with the claw member therebetween so as to rotate together with the rotation shaft.

In accordance with the present invention, there is also provided an image-forming apparatus comprising a plurality of process cartridges, each cartridge forming toner images with a color different from each other so as to transfer them onto a recording medium directly or via a transcriptive intermediate and to have recording images. Each of the process cartridges comprises a photosensitive drum connected to a rotation shaft of a transmission device that comprises a transmission member and the rotation shaft fitted into a mounting hole formed in the transmission member by press-fitting; and at least one process instrument for forming toner images on the photosensitive drum.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Embodiments according to the present invention will be described below in detail with reference to the drawings.

Figure 1:
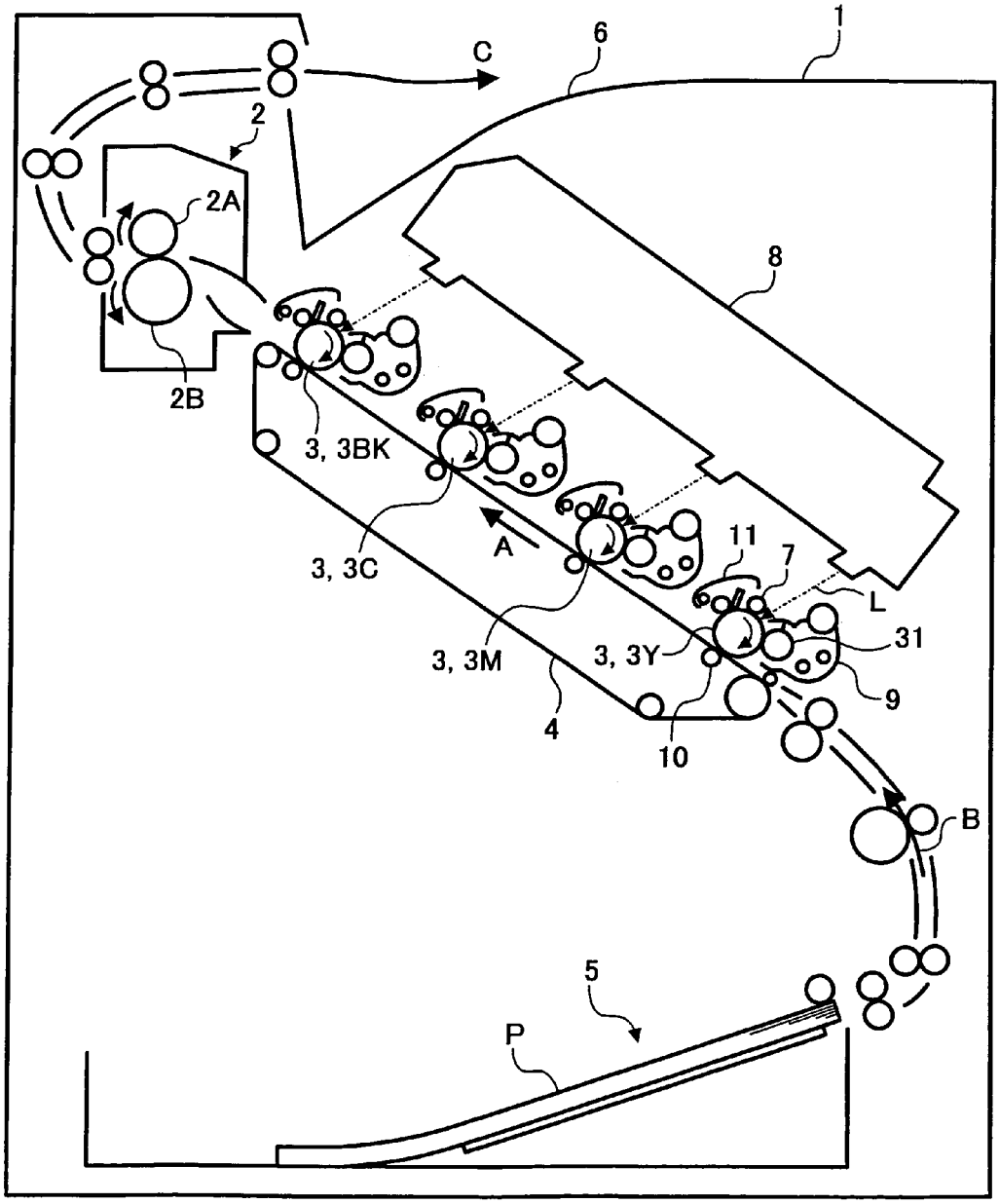
FIG. 1 is a drawing showing a schematic structure of an image-forming apparatus according to the present invention.

FIG. 1 is a schematic structural drawing of an example of an image-forming apparatus having a transmission device according to the embodiment. This image-forming apparatus is structured to be a printer, and includes four photosensitive drums 3 disposed within a body 1. On the external surfaces of the photosensitive drums 3, yellow toner images, magenta toner images, cyan toner images, and black toner images are formed, respectively. When these photosensitive drums are required to distinguish from each other, these are referred to first, second, third, and fourth photosensitive drums so as to have reference symbols 3Y, 3M, 3C, and 3BK, respectively. When these drums are not especially distinguished so as to have a general name, reference numeral 3 is added thereto.

A recording-medium conveying belt 4 is arranged so as to oppose the first to fourth photosensitive drums 3Y to 3BK. The recording-medium conveying belt 4 is stretched around a plurality of support rollers and is driven so as to travel in arrow A direction.

Since any photosensitive drum is identical in operation to the first to fourth photosensitive drums 3Y to 3BK forming toner images thereon, the configuration forming toner images on the first photosensitive drum 3Y will be only described here.

This first photosensitive drum 3Y is clockwise rotated in the drawing, and at this time, the surface of the first photosensitive drum 3Y is charged by a charging roller as an example of an electrification unit with a predetermined polarity. Then, the electrification surface is irradiated with a light-modulated laser beam L emitted from a laser write unit 8. Electrostatic latent images are thereby formed on the first photosensitive drum 3Y, and are visualized as yellow toner images by a development unit 9. The development unit 9 shown in the drawing includes a development roller 31, and the electrostatic latent images are visualized by dry developer carried on the development roller 31.

On the other hand, from a paper feed unit 5 arranged in a lower portion of the body 1, a recording medium P including transfer paper or a resin film is fed in arrow B direction so as to feed it between the first photosensitive drum 3Y and the recording-medium conveying belt 4.

The recording medium P is carried on the recording-medium conveying belt 4 so as to convey it. At a position substantially opposing the first photosensitive drum 3Y with the recording-medium conveying belt 4 therebetween, a transfer roller. 10 is arranged as an example of a transfer unit. By the function of the transfer roller 10, the yellow toner images on the first photosensitive drum 3Y is transferred onto the recording medium P. Residual toner which is not transferred onto the recording medium P is removed by a cleaning unit 11.

Quite similarly, on the second to fourth photosensitive drums 3M, 3C, and 3BK, magenta, cyan, and black toner images are formed, respectively. These toner images are sequentially transferred one on top the other on the recording medium P having the yellow toner images transferred thereon. The recording medium P carrying four-color unfixed toner images thereon in such a manner is fed to a fuser 2 so as to pass through the nip between a pair of fixing rollers 2A and 2B. At this time, the toner images are fixed on the recording medium P by thermal and pressure functions so that the recording medium P passed through the fuser 2 is discharged onto a discharge unit 6 as shown in arrow C.

Figure 2:
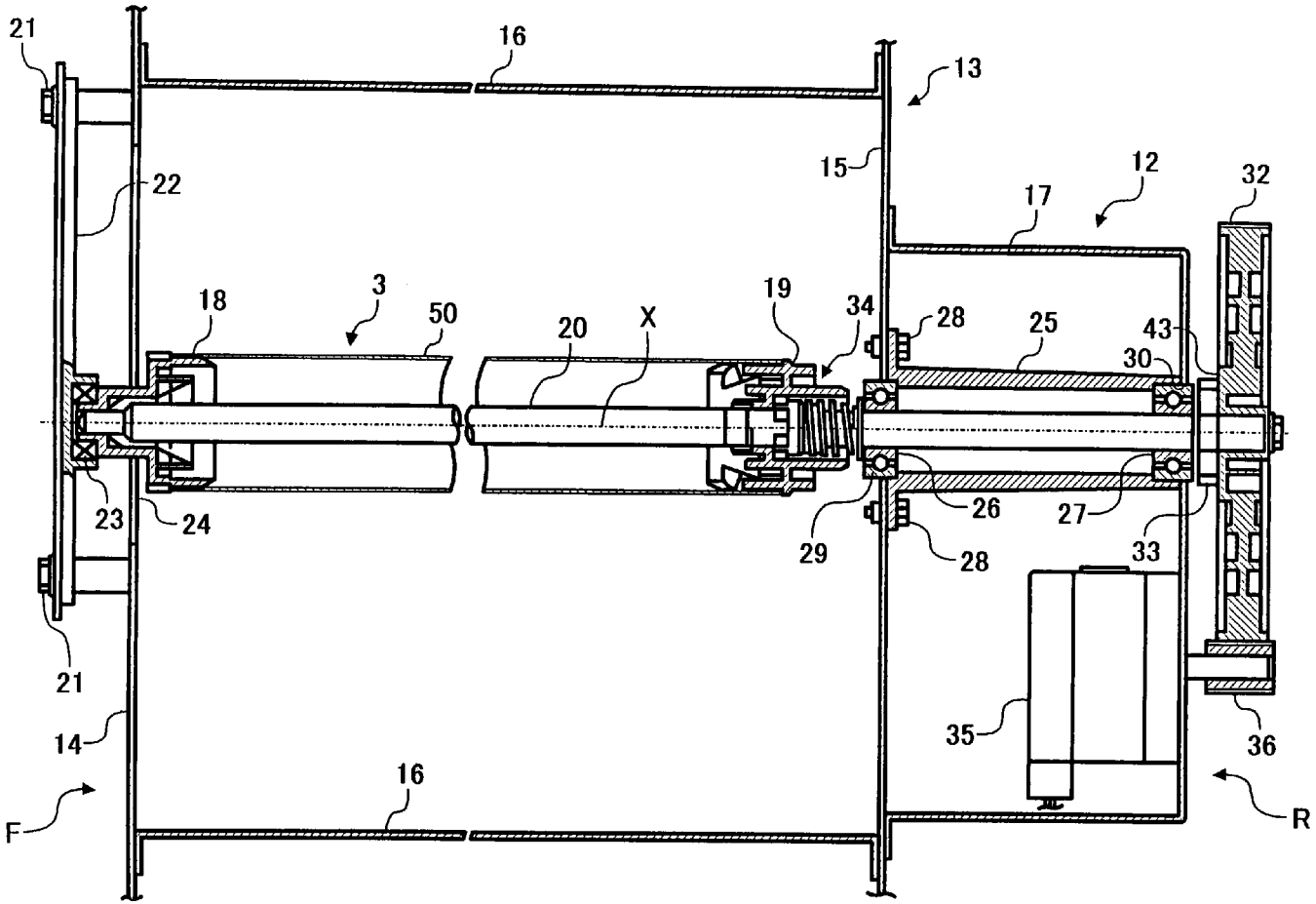
FIG. 2 is a sectional view showing a support structure of a photosensitive drum of the image-forming apparatus and a transmission device.

FIG. 2 shows structures of the photosensitive drum 3 and a transmission device 12 for transmitting rotation to the photosensitive drum 3. All the first to fourth photosensitive drums 3Y, 3M, 2C, and 3BK shown in FIG. 1 are supported in the same way, and the rotation can be transmitted thereto. FIGS. 2 to 8 show structures of these photosensitive drums, their support units, and transmission devices for transmitting the rotation to the photosensitive drums.

Symbol F in FIG. 2 denotes the foreground of the body 1; and symbol R the background thereof. A body frame 13 of the body 1 includes a fore side plate 14 located in the foreground, a back side plate 15 located in the background, stays 16 connecting and fixing between these side plates 14 and 15, and a body bracket 17 fixed to the back side plate 15 with screws (not shown). The photosensitive drum 3 includes a cylindrical drum body 50, and fore and back flanges 18 and 19 press-fitted into ends of the drum body 50 in the axial direction, respectively. On the external surface of the drum body 50, toner images are formed as described above. The fore flange 18 and the back flange 19 are detachably fixed to a rotation shaft 20, as will be described later, so that the rotation shaft 20 and the photosensitive drum 3 are integrally rotated.

To the fore side plate 14, a positioning member 22 is detachably fixed with a plurality of screws 21. The fore flange 18 is rotatably supported to the positioning member 22 with a bearing 23 therebetween. Also, into the fore flange 18, the fore end of the rotation shaft 20 is detachably fitted. In the foreground of the fore flange 18 and the rotation shaft 20, the fore side plate 14 is penetrated to have an opening 24 formed therein.

In the background of the rotation shaft 20, a pair of roller bearings 26 and 27 extending to penetrate the back side plate 15 and the body bracket 17 and retained by a cylindrical holder 25 are rotatably supported. The holder 25 is detachably fixed to the back side plate 15 with screws 28. Outer laces of the roller bearings 26 and 27 are tightly fitted into holes 29 and 30 formed in the body bracket 17 and thereby, both the roller bearings 26 and 27 and the holder 25 are positioned to the body frame 13. In such a manner, the rotation shaft 20 is correctly positioned and rotatably supported to the body frame 13, so that the fore flange 18 and the back flange 19 of the photosensitive drum 3 are coaxially supported on the rotation shaft 20.

As shown in FIG. 2, the transmission device 12 according to the embodiment includes the rotation shaft 20 rotatably supported as described above, a gear 32 fitted to the rotation shaft 20 and fixed thereto by press-fitting as will be described later as an example of a transmission member, a restriction member 33 which will be described later, and a connection unit 34 detachably connecting between the back flange 19 and the rotation shaft 20. The gear 32 is arranged coaxially with the rotation shaft 20 at the back end thereof. It is preferable that the gears 32 for the photosensitive drums 3Y to 3BK shown in FIG. 1 be entirely set identically in module and the number of teeth. Such a gear 32 may be any kind of gear such as a spur gear and a helical gear; according to the embodiment, the helical gear is used. The gear 32 is made of a metal or a resin; according to the embodiment, the gear 32 is a resin molded product.

To the body bracket 17, a drive motor 35 is supported, and an output gear 36 fixed to the output shaft of the drive motor 35 is mated with external teeth of the gear 32 mentioned above. The rotation of the drive motor 35 is transmitted to the rotation shaft 20 via the output gear 36 and the gear 32, and the rotation of the rotation shaft 20 is transmitted to the back flange 19 of the photosensitive drum 3 via the connection unit 34. Thereby, the photosensitive drum 3 is clockwise rotated in FIG. 1. The rotation of the output gear 36 may also be transferred to the gear 32 via another gear.

Instead of the gear 32, a transmission member including a pulley or a roller may also be fixed coaxially with the rotation shaft 20, and the rotation shaft 20 and the photosensitive drum 3 may be thereby driven by rotating the pulley or the roller via a belt. Such a transmission member including the pulley or the roller is a resin molded product for example. Any shape of the transmission member may be a resin molded product.

Figure 3:
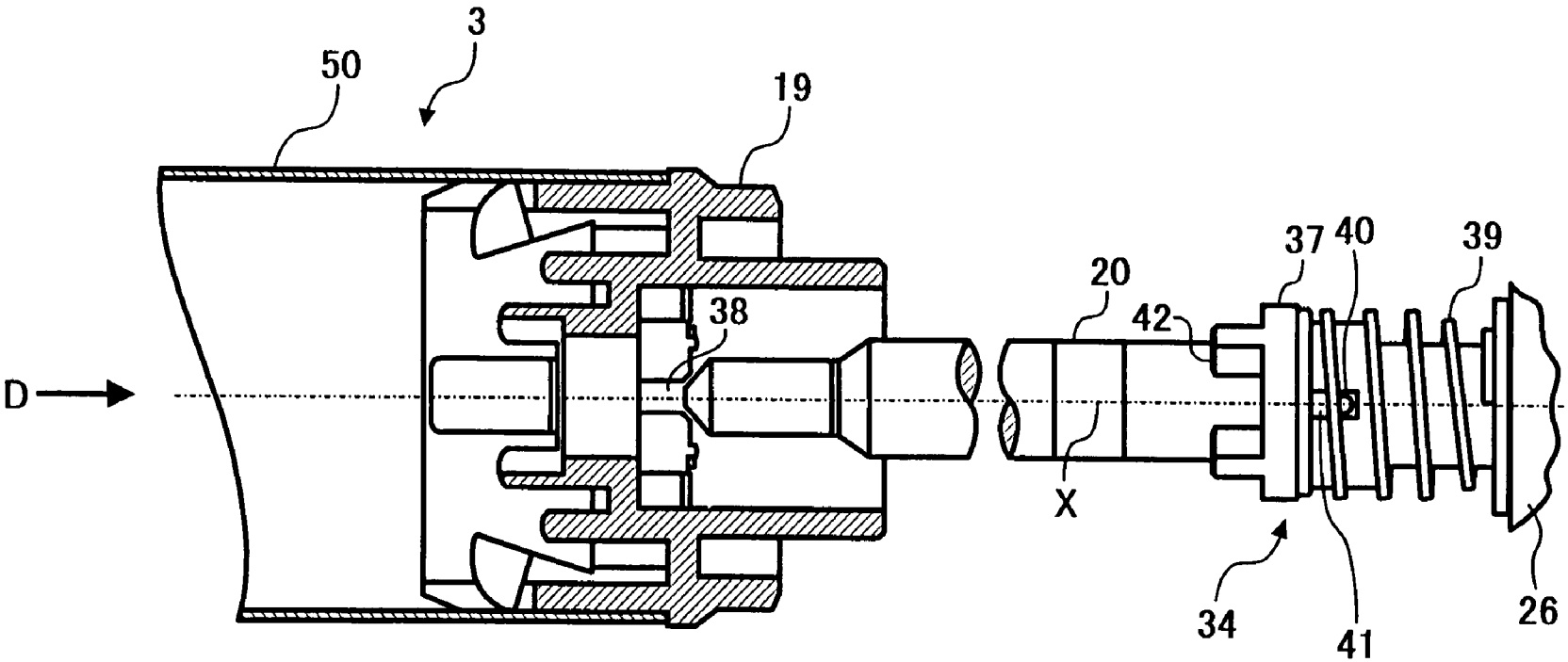
FIG. 3 is a sectional view showing a state that the photosensitive drum is taken off a rotation shaft of the transmission device.

The photosensitive drum 3 can be put on or taken off the rotation shaft 20 by displacing the photosensitive drum 3 in the axial direction X of the rotation shaft 20. FIG. 3 shows the state that the back flange 19 of the photosensitive drum 3 is detached from the rotation shaft 20. As shown in FIG. 3, the connection unit 34 includes a claw member 37 fitted to the rotation shaft 20 movably in the axial direction X with a predetermined stroke, a compression spring 39 for urging the claw member 37 in the axial direction of the rotation shaft 20, and a pin 40 stuck in the rotation shaft 20. To the pin 40, a long hole 41 formed in the claw member 37 is fitted relatively slidably in the axial direction X of the rotation shaft 20. In the state shown in FIG. 3, the claw member 37 is compressed by the compression spring 39 and the pin 40 is pressed into contact with one end of the long hole 41, so that the claw member 37 is retained at the position shown in FIG. 3. The claw member 37 is prevented from rotating about the rotation shaft 20 by the pin 40 fixed to the rotation shaft 20 and fitting into the long hole 41 of the claw member 37.

On the other hand, the back flange 19 of the photosensitive drum 3 is provided with an engagement unit formed therein and including a plurality of annularly-arranged engagement grooves. When such a photosensitive drum 3 is removed in arrow direction D of FIG. 3, and the photosensitive drum 3 is fitted to the rotation shaft 20 by inserting the rotation shaft 20 into the back flange 19 and the fore flange 18 (FIG. 2) so as to assemble the photosensitive drum 3 to the body frame 13 as shown in FIG. 2, the claw member 37 is pressed on the back flange 19 by the compression spring 39 so that a plurality of claws 42 formed in the claw member 37 in the peripheral direction are brought into engagement with the engagement unit including the engagement grooves 38 of the back flange 19 so as to prevent the photosensitive drum from relatively rotating about the rotation shaft 20. In such a manner, the photosensitive drum 3 is fitted to the rotation shaft 20 of the transmission device 12 and connected to the rotation shaft 20 with the claw member 37 therebetween so as to rotate together with the rotation shaft 20.

In contrast, the claw member 37 can be brought out of engagement with the engagement unit including the engagement grooves 38 by moving the photosensitive drum 3 along the rotation shaft 20 in a direction opposite to arrow D.

As described above, the photosensitive drum 3 has the engagement unit which is brought into or out of engagement with the claw member 37 by the movement of the photosensitive drum 3 itself in the axial direction of the rotation shaft 20, so that the photosensitive drum 3 can be put on or taken off the rotation shaft 20 by moving the photosensitive drum 3 in the axial direction of the rotation shaft 20.

The photosensitive drum 3 may also be directly connected to the rotation shaft 20 without interposing the connection unit therebetween as mentioned above. The photosensitive drum 3 is to be connected to the rotation shaft 20 directly or via another member. This is the same when a rotor other than the photosensitive drum is used.

Since the photosensitive drum 3 can be put on or taken off the rotation shaft 20 as described above, the photosensitive drum 3 can be drawn out of the body frame 13 in the foreground direction by taking the positioning member 22 shown in FIG. 2 off the fore side plate 14. Also, by the reverse operation, the photosensitive drum 3 can be assembled to the body frame 13 and fixed to the rotation shaft 20. In the state that the photosensitive drum 3 is assembled to the body frame 13, the gear 32 is rotated by the drive motor 35 and the rotation is transmitted to the photosensitive drum 3 via the rotation shaft 20 so as to rotate the photosensitive drum 3. At this time, in the transmission device 12 according to the embodiment, since the gear 32 and the output gear 36 are helical gears, the contact rate is increased, smoothly transmitting the rotation of the output gear 36 to the gear 32.

Figure 4:
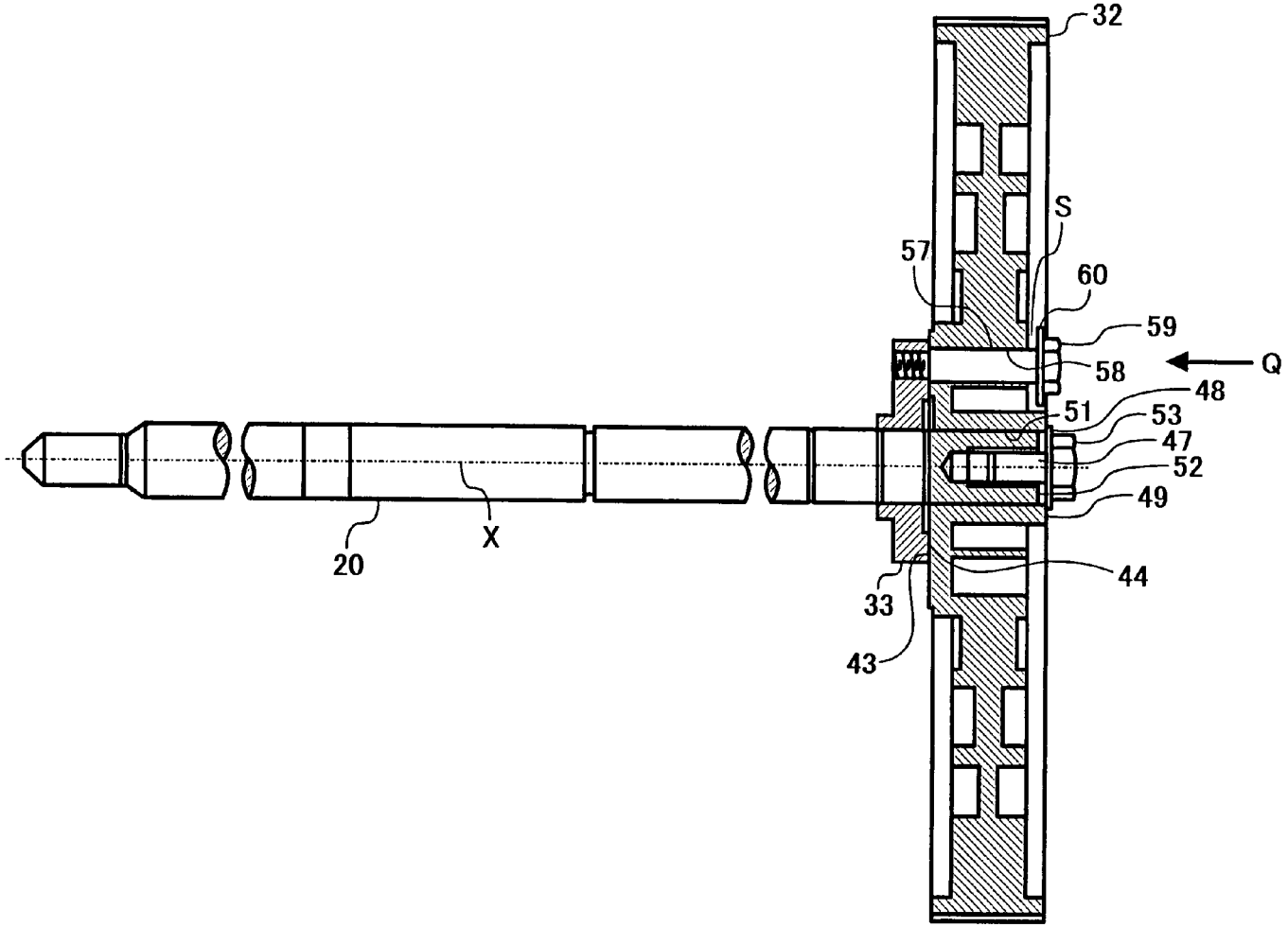
FIG. 4 is an enlarged sectional view showing a restriction member fixed to the rotation shaft and a gear.
Figure 5:
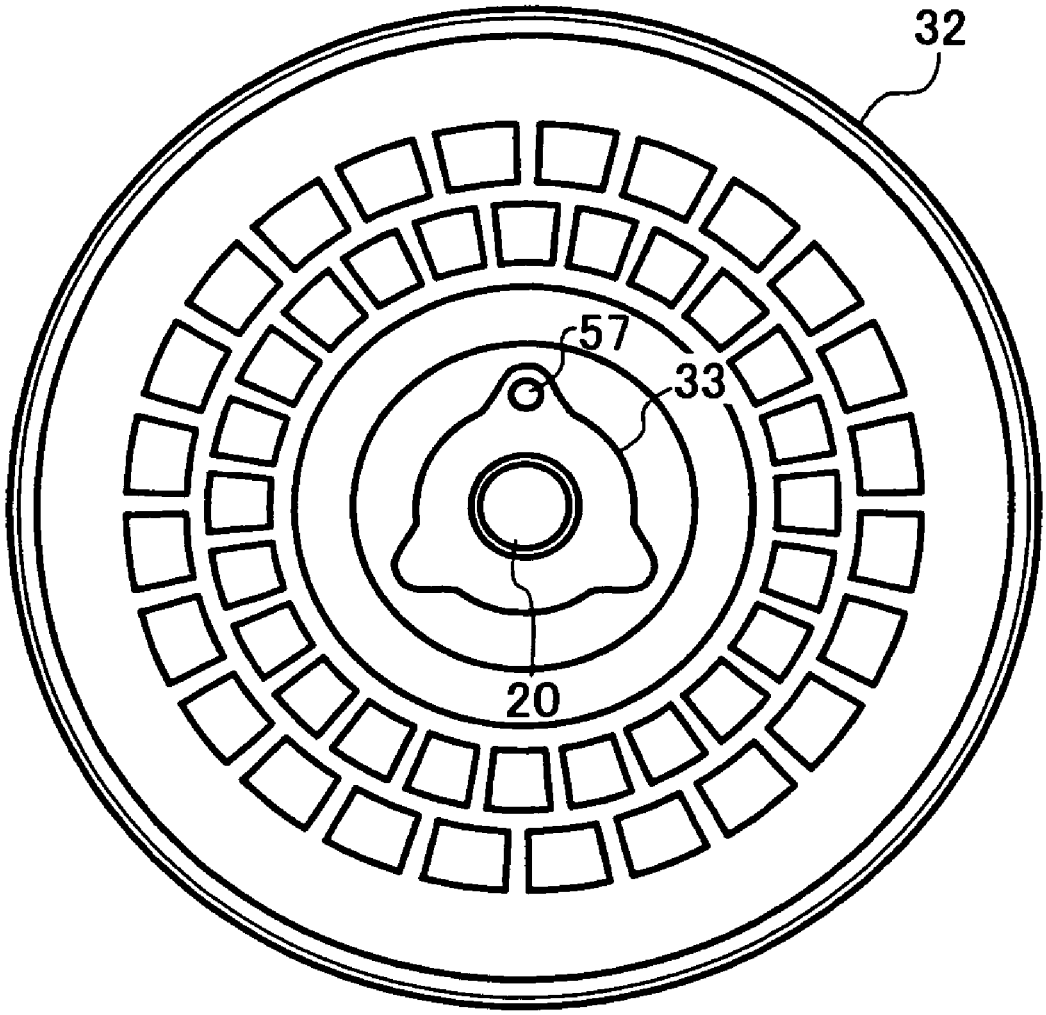
FIG. 5 is a drawing of the gear and the restriction member viewed from the left in FIG. 4.

As shown in FIG. 4, in the center of the gear 32, a mounting hole 51 is formed, and the rotation shaft 20 is fitted into the mounting hole 51 by press-fitting. Moreover, in the example shown in the drawing, the restriction member 33 mentioned above is fixed to the rotation shaft 20 by the pressing as shown in FIG. 5. A screw 47 is screwed into a female screw formed in the center at the back end of the rotation shaft 20, and a washer 48 of the screw 47 is pressed into contact with an end face 49 of the gear 32 opposite to the position of the restriction member 33 by fastening the screw 47. Thereby, one end face 43 of the gear 32 as an example of a transmission member in the axial direction is pressed into contact with the restriction member 33, and the angle of the gear 32 is restricted to the rotation shaft 20 so that the end face 43 of the gear 32 is at the right angle to the axial line X of the rotation shaft 20. The restriction member 33 is made so that a restriction surface 44 of the restriction member 33, which is pressed in contact with the one end face 43 of the gear 32, is at the right angle to the axial line X of the rotation shaft 20 in high accuracy, and the restriction surface 44 is pressed into contact with the one end face 43 of the gear 32 so as to increase the perpendicularity of the gear 32 to the axial line X. The restriction member 33 is made of a material having large rigidity and hardness, preferably a sintered metal.

At this time, even after the screw 47 is tightly fastened, the fixing position of the restriction member 33 is set so that a back end face 52 of the rotation shaft 20 is located slightly nearer to the restriction member 33 than the other end face 49 of the gear 32 in the axial direction. Thereby, the washer 48 is tightly pressed into contact with the other end face 49 of the gear 32 by fastening the screw 47. The gear 32 fitted to the rotation shaft 20 is, therefore, pressed to the restriction member 33 strongly so that the one end face 43 thereof is strongly pressed on the restriction surface 44 of the restriction member 33 while the gear 32 is fixed to the restriction member 33 and is also tightly fixed to the rotation shaft 20. Without the washer 48, the head 53 of the screw 47 may also be directly pressed on the other end face 49 of the gear 32.

Also, in the transmission device 12 according to the embodiment, as shown in FIGS. 4 and 5, a hinge screw 57 is inserted into a through-hole 58 formed in the gear 32 so as to screw into the restriction member 33. Thereby, the gear 32 and the restriction member 33 are integrated more tightly.

At this time, the hinge screw 57 is inserted into the through-hole 58 of the gear 32 from the other side face 49 of the gear 32, as shown in arrow Q in FIG. 4, and the hinge screw 57 is fixed to the restriction member 33 by fastening the screw portion of the hinge screw 57 to the restriction member 33. However, the hinge screw 57 is not screwed with the gear 32 and moreover, a clearance S is produce between the head 59 of the hinge screw 57 or a washer 60 thereof and the other side face 49. The head 59 of the hinge screw 57 is structured so as not to press the other side face 49 of the transmission member directly or via the washer 60 when the screw portion of the hinge screw 57 is fastened to the restriction member 33.

By such an arrangement, when the hinge screw 57 is fastened, the gear 32 cannot be deformed by the fastening, thereby increasing the perpendicularity of the gear 32 to the axial line X.

As described above, the transmission device 12 according to the embodiment includes the gear 32 as an example of the transmission member and the rotation shaft 20 fitted into the mounting hole 51 formed in the transmission member by press-fitting. Since the gear 32 is fitted to the rotation shaft 20 by the pressing, a clearance generating backlash between both the members cannot be produced, substantially eliminating the eccentricity of both the members due to the backlash to the rotation shaft 20. Thus, during the operation of the photosensitive drums 3Y to 3BK, uneven speeds are suppressed in these drums, thereby effectively preventing problems of color misalignment in color images transferred on a recording medium P.

However, as described above, when the mounting hole 51 of the gear 32 is fitted to the rotation shaft 20 by the press-fitting, a large force is required during the fitting, which may deteriorate the efficiency of assembling. Also, when the gear 32 is a resin molded product, the inner diameters of the mounting holes 51 largely vary so that the assembly efficiency during pressing the rotation shaft 20 into the mounting hole 51 may be largely decreased.

Figure 6:
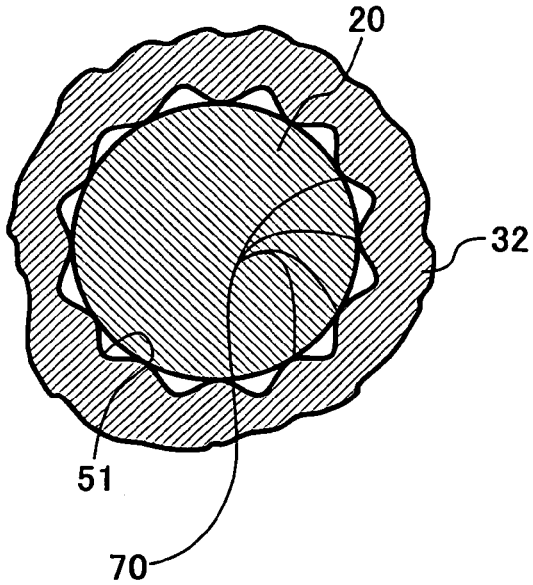
FIG. 6 is an enlarged cross-sectional view of a fitting part between the rotation shaft and the gear fitted to the rotation shaft.

Then, in the transmission device according to the embodiment, as shown in FIG. 6, on the internal surface of the mounting hole 51 formed in the gear 32 as an example of the transmission member, projections 70 are formed so as to contact the external surface of the rotation shaft 20.

A plurality of the projections 70 are formed on the internal surface of the mounting hole 51 in the peripheral direction. Only the plurality of the projections 70 are pressed into contact with the external surface of the rotation shaft 20 while concave portions between the projections 70 do not abut the external surface of the rotation shaft 20. In the example shown in the drawing, the cross section of the rotation shaft 20 is circular. In such a manner, although the rotation shaft 20 is fitted into the mounting hole 51 by the press-fitting, since the contact area between both the members is decreased, the gear 32 can be assembled to the rotation shaft 20 by pressing with a small force, increasing the assemble efficiency.

Figure 7:
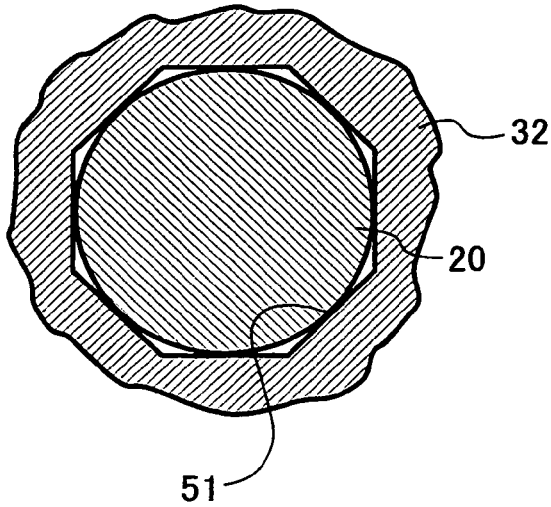
FIG. 7 is an enlarged sectional view of another example of the fitting part similar to that in FIG. 6.
Figure 8:
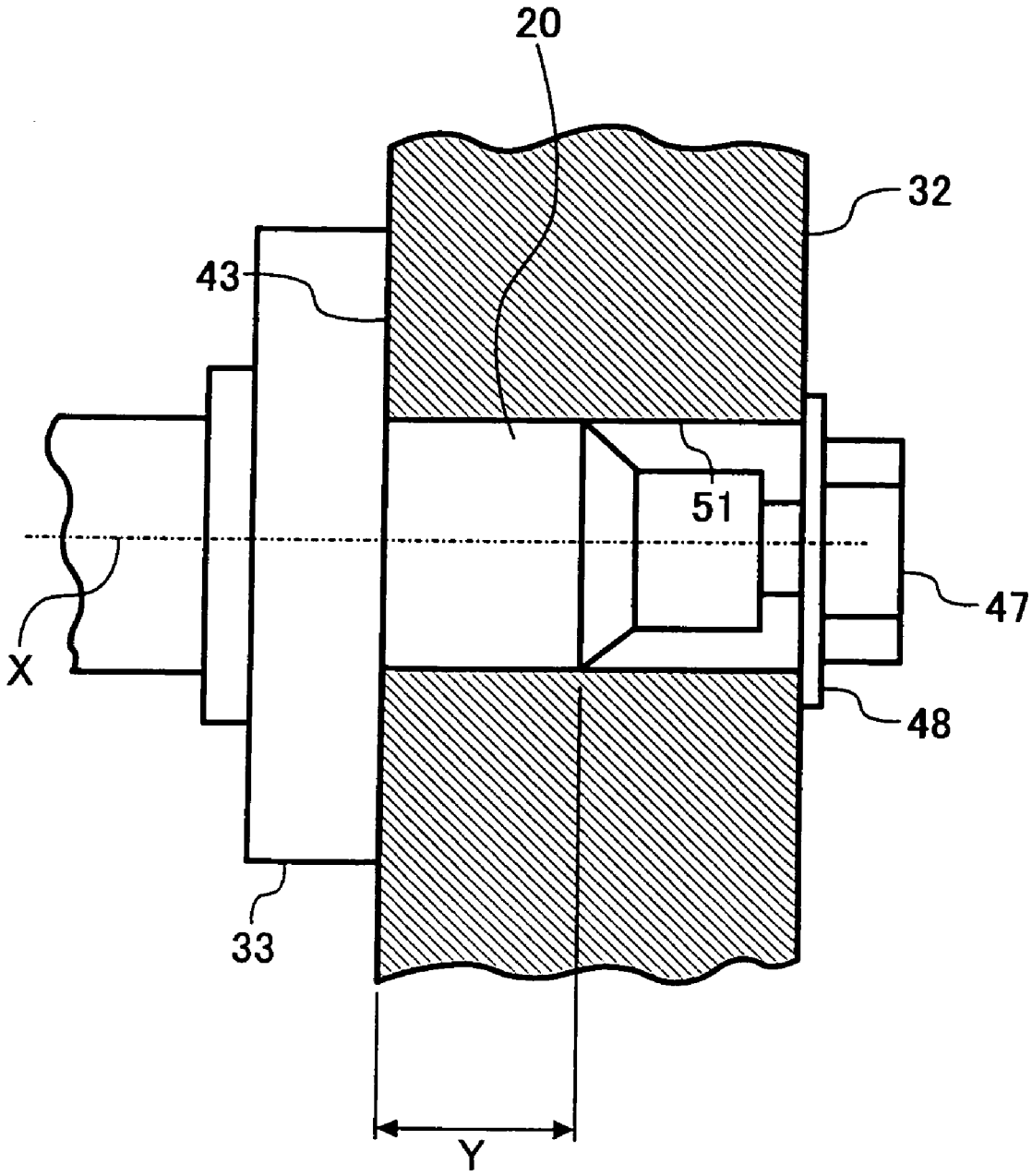
FIG. 8 is a longitudinal sectional view of another example of the fitting part between the rotation shaft and the gear.

Also, as shown in FIG. 7, when the cross section of the mounting hole 51 of the gear 32 is formed to have a polygonal shape so that part of sides defining the polygon is brought into contact with the external surface of the rotation shaft 20, the same effects as those described above can be taken. Only part of sides of the polygon is pressed in contact with the external surface of the rotation shaft 20. Moreover, the gear 32 according to the embodiment is a resin molded product; when the mounting hole 51 is formed to have a polygonal shape, a mold for molding the gear 32 can be easily structured with low cost. In the example shown in FIG. 7, the cross section of the rotation shaft 20 is also circular.

As described above, by forming the mounting hole and the rotation shaft so that only part in the peripheral direction of the internal surface defining the mounting hole of the transmission member is brought into contact with the external surface of the rotation shaft, the rotation shaft can be easily fitted into the transmission member by press-fitting with a small force.

Also, while the arrangements described above are adopted, as shown in FIG. 8, when only part Y in the axial line X of the external surface of the rotation shaft 20 fitted into the mounting hole 51 of the gear 32 as an example of the transmission member is brought into contact with the internal surface of the mounting hole of the transmission member including the gear 32 and fitted thereto, the pressing force during the pressing can be largely reduced, further improving the assembly efficiency. Only the part shown by symbol Y in FIG. 8 of the mounting hole 51 in the peripheral direction is pressed into contact with the external surface of the rotation shaft 20, as shown in FIGS. 6 and 7.

By the arrangements described above, although the gear 32 can be fitted to the rotation shaft 20 with a very small pressing force, since the region Y in the axial direction is decreased small, in which the mounting hole 51 is pressed in contact with the rotation shaft 20, when the rotation shaft 20 is simply fitted into the mounting hole 51, the gear 32 may fall over the rotation shaft 20. Whereas in the transmission device according to the embodiment, as described above, since by pressing the end face 43 of the transmission member including the gear 32, the restriction member 33 is fixed to the rotation shaft 20 for restricting the angle of the transmission member to the rotation shaft 20 so that the end face 43 is at the right angle to the axial line X of the rotation shaft 20, the problem that the transmission member falls down can be prevented.

In the transmission device 12 according to the embodiment described above, a rotor including the photosensitive drum 3 rotating together with the rotation shaft 20 is connected to the rotation shaft 20 with the connection unit 34 therebetween so as to transmit the rotation of the transmission member including the gear 32 to the rotor via the rotation shaft 20. Alternatively, other than the photosensitive drum 3, the transfer roller 10, the development roller 31, the fixing rollers 2A and 2B, and the support roller for supporting the recording-medium conveying belt for carrying a recording medium, which are shown in FIG. 1, and moreover a rotor, which is not shown in FIG. 1, such as a support roller for supporting an image-carrier belt such as a photosensitive belt and a transcriptive intermediate belt, to which toner images are transferred from a photosensitive member, may also be connected to the rotation shaft 20 directly or via another member so as to rotate these rotors. In the examples shown in the drawings, the rotation of the gear 32 is transmitted to the rotation shaft 20; alternatively, the structures described above may be applied to a transmission device for transmitting the rotation of a rotation shaft to a transmission member such as a gear.

Also, according to the embodiment, the arrangement has been described in which the photosensitive drum 3 is independently put on or taken off the body 1 of the image-forming apparatus. Since around the photosensitive drum 3, a plurality of process instruments are provided for forming toner images on the photosensitive drum, such as an electrification unit, a development unit, and a cleaning unit, the photosensitive drum structured as described above may be integrated with at least one process instrument for forming toner images on the photosensitive drum so as to form a process cartridge. Then, the process cartridge may also be put on or taken off the body of the image-forming apparatus.

Figure 9:
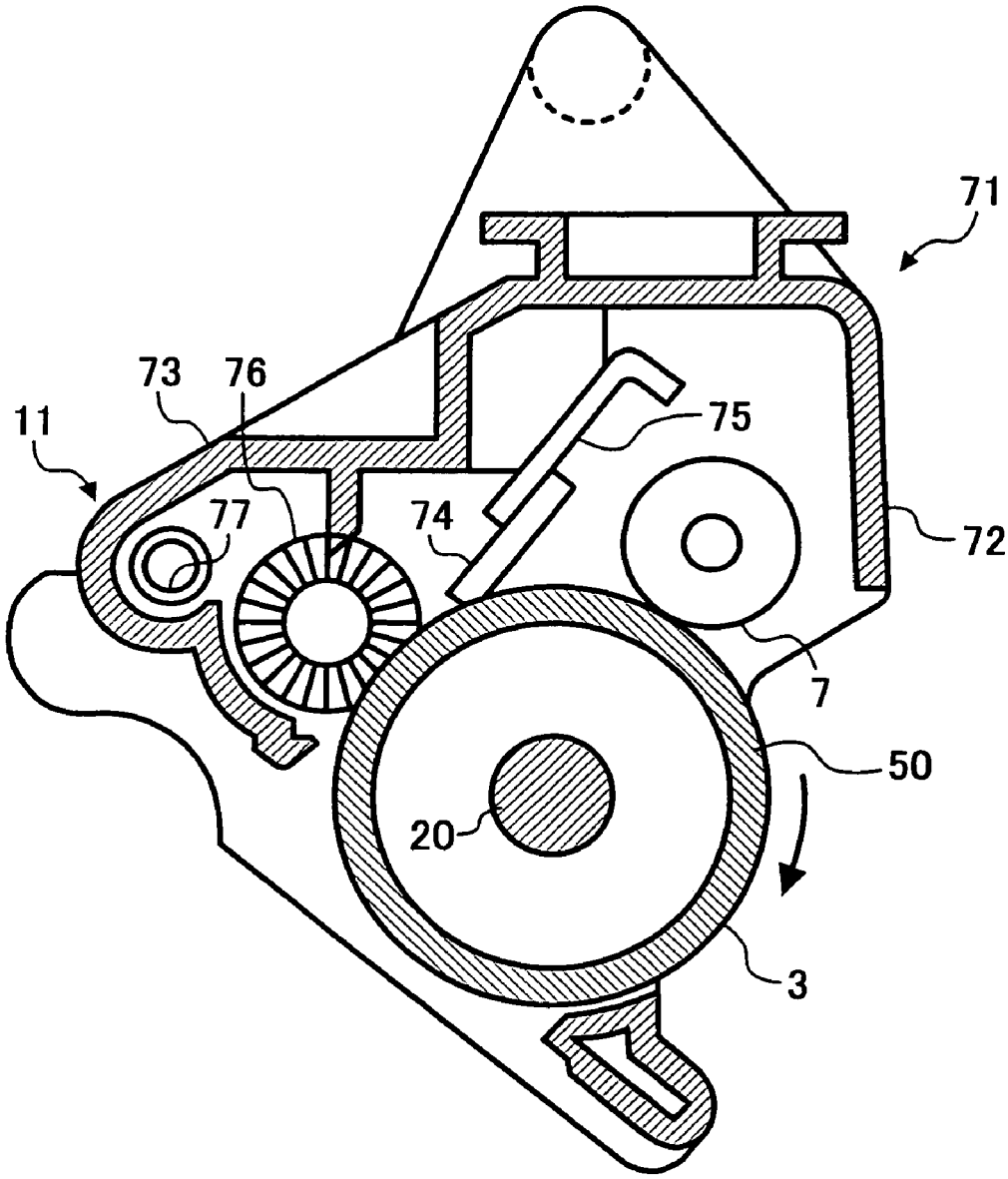
FIG. 9 is a sectional view showing a structure of a process cartridge according to the present invention.

FIG. 9 shows a structure of an example of such a process cartridge 71. The process cartridge 71 shown in the drawing, as shown also in FIG. 2, includes the photosensitive drum 3 fixed to the rotation shaft 20 by detachably fitting to the rotation shaft 20 while including two process instruments of a charging roller 7 as an example of an electrification unit for electrifying the surface of the photosensitive drum 3 and a cleaning unit 11 for cleaning the surface of the photosensitive drum, so that these process instruments and the photosensitive drum 3 are integrally assembled. More specifically, to a case 72 of the process cartridge 71, the back flange and the fore flange (see FIG. 2) are rotatably assembled while the charging roller 7 is supported to the case 72; part of the case 72 forms a cleaning case 73 of the cleaning unit 11; to the cleaning case 73, the base of a cleaning blade 74 is fixed with a blade holder 75 therebetween; and moreover, a cleaning brush 76 and a toner-conveying screw 77 are rotatably supported to the cleaning case 73. Both the cleaning blade 74 and the cleaning brush 76 abut on the peripheral surface of the drum body 50 of the photosensitive drum 3.

Also, around the photosensitive drum 3, a development unit (not shown in FIG. 9) is provided as another element different from the process cartridge 71. The charging roller 7 shown in FIG. 9 contacts the peripheral surface of the photosensitive drum 3; alternatively, the charging roller 7 may be located so as to have a slight clearance to the peripheral surface and to electrify the photosensitive drum 3 by the electric discharge within the clearance.

On the photosensitive drum 3 shown in FIG. 9, toner images are formed in quite the same way as described above with reference to FIG. 1 so as to transfer them on a recording medium (not shown in FIG. 9). After the transferring of the toner images, residual toner stuck on the surface of the photosensitive drum is removed from the drum surface by the co-operation of the cleaning brush 76 and the cleaning blade 74 in the cleaning unit 11. The removed toner is conveyed outside the cleaning case 73 by the toner-conveying screw 77.

Other structures of the photosensitive drum 3, its support structure, and the arrangement of the transmission device for transferring the rotation of the photosensitive drum 3 are the same as described above. By moving the photosensitive drum 3 along the rotation shaft 20 in the axial direction, the photosensitive drum 3 can be put on or taken off the rotation shaft 20, so that the entire process cartridge 71 shown in FIG. 9 is put on or taken off the body of the image-forming apparatus.

Figure 10:
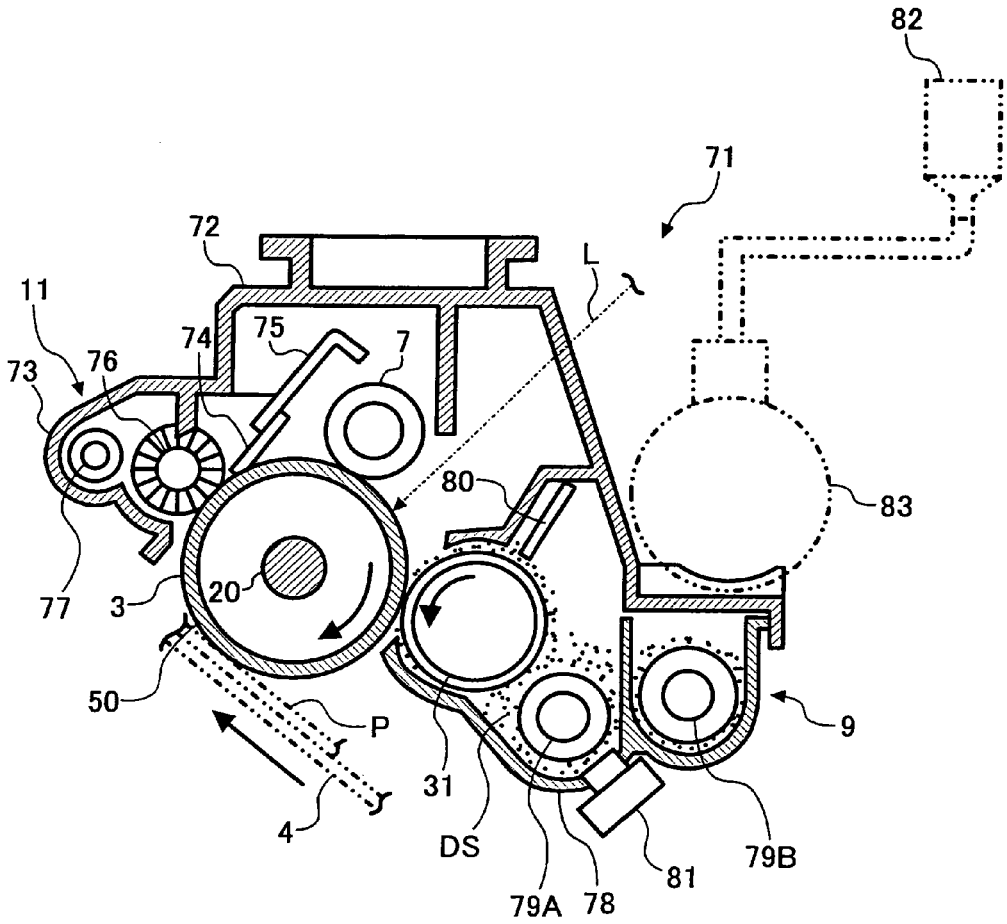
FIG. 10 is a sectional view showing a structure of another example of the process cartridge.

In the process cartridge 71 shown in FIG. 10 as another example, the development unit 9 is also a component part of the process cartridge 71. That is, part of the case 72 of the process cartridge 71 forms a development case 78 of the development unit 9; to the development case 78, the development roller 31 and developer-conveying screws 79A and 79B are rotatably supported; and moreover, a doctor blade 80 and a toner-density sensor 81 are fixed to the development case 78. The development roller 31 is located in close vicinity to the surface of the photosensitive drum 3 while the edge of the doctor blade 80 is located close to the surface of the development roller 31. Within the development case 78, dry developer DS containing toner and carrier is contained. Other structures of the process cartridge 71 are identical to those of the process cartridge shown in FIG. 9.

The image-forming apparatus having the process cartridge 71 shown in FIG. 10 also forms images on a recording medium in the same way as that of the image-forming apparatus shown in FIG. 1. That is, the photosensitive drum 3 rotating clockwise in FIG. 10 is electrified by the charging roller 7; the charged surface is exposed with a laser beam L so as to form electrostatic latent images on the photosensitive drum 3; and the electrostatic latent images are visualized by the development unit 9 as toner images.

In the development unit 9, by the rotation of the developer-conveying screws 79A and 79B, toner and carrier of the developer DS are electrostatically friction-charged in polarities opposite to each other while the development roller 31 is rotated counterclockwise in FIG. 10 so as to convey the developer DS carried on the peripheral surface of the development roller 31 in the rotating direction thereof. At this time, the layer thickness of the developer on the development roller 31 is restricted by the doctor blade 80; the developer passing through the doctor blade 80 is conveyed to a development region between the development roller 31 and the photosensitive drum 3; and in the development region, the toner electrostatically becomes electrostatic latent images so as to be visualized as toner images.

The toner images are transferred onto a recording medium P carried and conveyed on the recording-medium conveying belt 4 indicated by a two-dot chain line in FIG. 10. After the transfer of the toner images, it is identical to the image-forming apparatuses shown in FIGS. 1 and 9 that residual toner stuck on the photosensitive drum 3 is removed by the cleaning unit 11.

When reduction in density of the developer DS contained within the development case 78 is detected by the toner density sensor 81, toner contained in a toner container 82 indicated by a two-dot chain line in FIG. 10 is supplied to the development case 78 by a powder pump 83.

A plurality of the process cartridges 71 shown in FIGS. 9 and 10, preferably at least four cartridges, are provided so as to sequentially transfer toner images with respective colors different from each other on a recording medium one on top the other in the same way as that of the image-forming apparatus shown in FIG. 1, thereby obtaining high-quality color images with reduced color misalignment.

Also, in the image-forming apparatus shown in FIG. 1, toner images formed on each photosensitive drum are directly transferred onto a recording medium one on top the other so as to obtain recording images; alternatively, toner images formed on each photosensitive drum with respective colors different from each other may be primarily transferred in piles onto a transcriptive intermediate including an endless belt or a drum, for example, and then the toner images may be secondarily transferred onto a recording medium so as to fix them. That is, the image-forming apparatus includes a plurality of the photosensitive drums 3Y to 3BK or a plurality of the process cartridges 71 while having a plurality of the transmission devices 12. The photosensitive drums 3Y to 3BK rotating integrally with the rotation shafts 20 of these transmission devices 12 are connected to the respective rotation shafts 20 directly or via another member so as to respectively form toner images on each photosensitive drum with respective colors different from each other. The toner images are transferred onto a recording medium directly or via the transcriptive intermediate so as to obtain recording images. By incorporating the structures described above to this image-forming apparatus mentioned above, high-quality color images can be obtained with reduced color misalignment and moreover, the efficiency in assembling between the rotation shaft 20 of the transmission device and the transmission member can be improved.

When the resin gear 32 is used, even if the eccentricity due to backlashes between the gear and the rotation shaft 20 does not exist, eccentricity in the gear itself is produced during molding the gear, so that slight color misalignment may be produced in the color images formed on a recording medium. In order to prevent such a problem, arranging the gears for the photosensitive drums 3Y to 3BK so as to have a predetermined phase relation in the rotational direction of the gears, as is generally known in itself, color misalignment in the color images is prevented so as to obtain color images with further improved quality.

The present invention, other than to printers, may also be applied to image-forming apparatuses including copying machines, facsimile systems, printing presses, and compound machines of these machines, and an image-forming apparatus having only one photosensitive drum so as to form black toner images thereon, obtaining monochrome images on a recording medium by transferring the toner images onto the recording medium. Furthermore, transmission devices in other machines and devices may widely incorporate the invention.

According to the present invention described above, the rotation shaft can be easily fitted into the mounting hole of the transmission member by press-fitting.

Various modifications will become possible for those skilled in the art after receiving the teachings of the present disclosure without departing from the scope thereof.

What is claimed is:

1. A transmission device comprising:

a transmission member; and a rotation shaft fitted into a mounting hole formed in the transmission member, wherein the mounting hole and the rotation shaft are arranged so that part of the internal surface defining the mounting hole in the peripheral direction is only brought into contact with the external surface of the rotation shaft.

2. A device according to claim 1, wherein the internal surface of the mounting hole is provided with a plurality of projections formed on the internal surface in the peripheral direction and contacting the external surface of the rotation shaft.

3. A device according to claim 1, wherein the mounting hole is formed into a polygonal, and wherein part of each of sides defining the polygon is brought into contact with the external surface of the rotation shaft.

4. A device according to claim 1, further comprising a restriction member fixed to the rotation shaft for restricting an angle of the transmission member to the rotation shaft so that one end-face of the transmission member is at a right angle to the axial line of the rotation shaft by pressing in contact with the one end-face of the transmission member, wherein only part of the external surface of the rotation shaft fitted to the mounting hole of the transmission member in the axial direction of the rotation shaft is brought into contact with the internal surface of the mounting hole of the transmission member.

5. A device according to claim 1, wherein the transmission member comprises a gear.

6. A device according to claim 5, wherein the transmission member comprises a helical gear.

7. A device according to claim 1, wherein the transmission member comprises a resin molded product.

8. A device according to claim 1, further comprising a rotor rotating together with the rotation shaft and connected to the rotation shaft directly or via a coupler so as to transmit the rotation of the transmission member to the rotor via the rotation shaft.

9. A device according to claim 8, wherein the rotor is any one of a photosensitive drum, a transfer roller, a development roller, a fixing roller, a recoding-medium conveying roller, a support roller for supporting an image carrier belt, and a support roller for supporting a recording-medium conveying belt for carrying and conveying a recording medium.

10. A photosensitive drum to be connected to a rotation shaft of a transmission device, the transmission device comprising:

a transmission member;

the rotation shaft fitted into a mounting hole formed in the transmission member by press-fitting; and a claw member, wherein the photosensitive drum is fitted to the rotation shaft of the transmission device with the claw member therebetween so as to rotate together with the rotation shaft.

11. A drum according to claim 10, wherein the mounting hole and the rotation shaft are arranged so that part of the internal surface defining the mounting hole in the peripheral direction is only brought into contact with the external surface of the rotation shaft.

12. A drum according to claim 11, comprising an engagement part that is brought into or out of contact with the claw member by the movement of the photosensitive drum itself in the axial direction of the rotation shaft.

13. A drum according to claim 11, wherein the photosensitive drum is put on or taken off the rotation shaft by the movement of the photosensitive drum in the axial direction of the rotation shaft.

14. A process cartridge comprising:

a photosensitive drum to be connected to a rotation shaft of a transmission device that comprises a transmission member and the rotation shaft fitted into a mounting hole formed in the transmission member by press-fitting; and at least one process instrument for forming toner images on the photosensitive drum.

15. A cartridge according to claim 14, wherein the photosensitive drum is fitted to the rotating shaft of the transmission device with a claw member therebetween so as to rotate together with the rotation shaft.

16. An image-forming apparatus comprising a transmission device that comprises a transmission member and a rotation shaft fitted into a mounting hole formed in the transmission member by press-fitting, wherein the mounting hole and the rotation shaft are arranged so that part of the internal surface defining the mounting hole in the peripheral direction is only brought into contact with the external surface of the rotation shaft.

17. An image-forming apparatus comprising a photosensitive drum to be connected to a rotation shaft of a transmission device that comprises a transmission member, the rotation shaft fitted into a mounting hole formed in the transmission member by press-fitting, and a claw member, wherein the photosensitive drum is fitted to the rotating shaft of the transmission device with the claw member therebetween so as to rotate together with the rotation shaft.

18. An image-forming apparatus comprising a process cartridge, wherein the process cartridge comprises:

a photosensitive drum to be connected to a rotation shaft of a transmission device that comprises a transmission member and the rotation shaft fitted into a mounting hole formed in the transmission member by press-fitting; and at least one process instrument for forming toner images on the photosensitive drum.

19. An apparatus according to claim 18, wherein the photosensitive drum is fitted to the rotating shaft of the transmission device with a claw member therebetween so as to rotate together with the rotation shaft.

20. An image-forming apparatus comprising a plurality of photosensitive drums, each drum forming toner images with a color different from each other so as to transfer them onto a recording medium directly or via a transcriptive intermediate and to have recording images, wherein each of the photosensitive drums is connected to a rotation shaft of a transmission device that comprises a transmission member, the rotation shaft fitted into a mounting hole formed in the transmission member by press-fitting, and a claw member, and each of the photosensitive drums is fitted to the rotating shaft with the claw member therebetween so as to rotate together with the rotation shaft.

21. An image-forming apparatus comprising a plurality of process cartridges, each cartridge forming toner images with a color different from each other so as to transfer them onto a recording medium directly or via a transcriptive intermediate and to have recording images, wherein each of the process cartridges comprises:

a photosensitive drum connected to a rotation shaft of a transmission device that comprises a transmission member and the rotation shaft fitted into a mounting hole formed in the transmission member by press-fitting; and at least one process instrument for forming toner images on the photosensitive drum.

* * * * *